United States Patent [19]

Norris

[11] Patent Number: 4,953,659

[45] Date of Patent: Sep. 4, 1990

[54] FLUID BLOW-OFF MUFFLER

[76] Inventor: Thomas R. Norris, 15 Patricia Rd., Orinda, Calif. 94563

[21] Appl. No.: 398,792

[22] Filed: Aug. 25, 1989

[51] Int. Cl.[5] ..... F01N 1/10

[52] U.S. Cl. ..... 181/257; 181/238; 181/258; 181/268; 181/272; 181/296

[58] Field of Search ..... 181/232, 243, 253–258, 181/268, 269, 296, 238, 272

[56] References Cited

U.S. PATENT DOCUMENTS

| | | | |
|---|---|---|---|
| 226,905 | 4/1980 | Curie | 181/257 |
| 1,519,527 | 12/1924 | Bumbaugh et al. | 181/257 |
| 2,625,234 | 1/1953 | Fina | 181/239 |
| 4,353,434 | 10/1982 | Norris | 181/258 |
| 4,682,470 | 7/1987 | Shaff | 181/156 X |

FOREIGN PATENT DOCUMENTS

| | | |
|---|---|---|
| 10047 | of 1892 | United Kingdom . |
| 250399 | 4/1926 | United Kingdom . |

OTHER PUBLICATIONS

Dresser Industries–Product Information Consolidated Silencers, p. SV/PI-33A, Date: Jan. 10, 1980.

Fluid Kinetics–Blow–Off Silencers.

*Primary Examiner*—Benjamin R. Fuller

*Attorney, Agent, or Firm*—Townsend and Townsend

[57] ABSTRACT

This invention provides an improved method and apparatus for attenuating the sound of flowing fluid. The apparatus of this invention includes at least two attenuating areas, preferably particle-filled containers arranged serially within a housing. One of the attenuating areas has a central void into which a portion of the fluid may flow on its way through the muffler. The muffler may also include a mechanism for permitting one of the attenuating devices to move in order to accommodate changes in fluid pressure. The method includes the steps of introducing a pressurized fluid into first flow resisting means disposed within a housing; passing all of the fluid from the first speed dissipating means into a first void disposed within the housing; splitting the flow in the first void into first and second subflows; passing the first subflow from the first void into a second flow resisting means disposed within the housing; passing the first subflow out of the housing; and passing the second subflow from the first void out of the housing without passing into the second speed dissipating means.

40 Claims, 5 Drawing Sheets

FLUID BLOW-OFF MUFFLER

BACKGROUND OF THE INVENTION

This invention relates to a device for attenuating noise generated by a pressurized fluid when released to the atmosphere, especially steam, for example from a geothermal power plant.

Rock-filled type mufflers have been used for attenuating noise generated by pressurized steam upon release to the atmosphere. These mufflers generally consist of a container filled with rock aggregate, typically of 1–6 inch screening. The pressurized steam is introduced at or near the bottom of the container, passes through the body of the aggregate and exits from the surface. In general, the fill is not held in place by a screen or grill because a failure could cause a sudden dangerous ejection of hot rock. In order to prevent ejection of the fill, therefore, conventional rock-filled mufflers are made very large to accommodate steam surges and hence are very costly and difficult to site.

One alternative to the conventional rock filled muffler is disclosed in U.S. Pat. No. 4,353,434, the disclosure of which is incorporated herein by reference. In that muffler, a pressurized fluid stream is introduced via a distributor into a basal or lateral compartment of the container which is separated from the rock fill by a perforated element made of masonry, concrete, wire mesh, metal plate or metal grid. A portion of the pressurized fluid flows through the fill to the atmosphere, and a portion flows from the fill into a void volume formed within the fill before exiting the muffler.

Blow off mufflers that flow steam past fiber-filled baffles usually provide adequate silencing but have high cost and potentially poor longevity. Compact particle-filled mufflers, in contrast, have excellent longevity and modest cost, but only modest noise reduction, so have seen relatively little use.

SUMMARY OF THE INVENTION

This invention provides an improved particle-fill blow-off muffler method and apparatus for attenuating the sound of flowing fluid. The muffler of this invention includes at least two sound attenuating areas, preferably a particle-filled container or a plurality containers arranged serially within a housing. The flow path of the fluid takes the fluid into the first attenuating area, then into an intermediate void. The flow then splits, a portion of it going into the second attenuating area and a portion leaving the device without going into the second sound attenuating area. At least one of the attenuating areas has a central void into which a portion of the fluid may flow on its way through the muffler. The muffler also includes a mechanism for permitting one or both of the attenuating devices to move in order to accommodate changes in fluid pressure.

The sound attenuation of this design is enhanced by avoiding direct impingement of intense unattenuated inlet noise on the muffler housing, which would cause the housing to emit noise. The efficient use of fill material also allows relatively small size and high empty space within the housing, thereby reducing both cost and weight.

Other advantages of this invention will be apparent from the description below.

DETAILED DESCRIPTION OF THE PREFERRED EMBODIMENT

Figure 1:
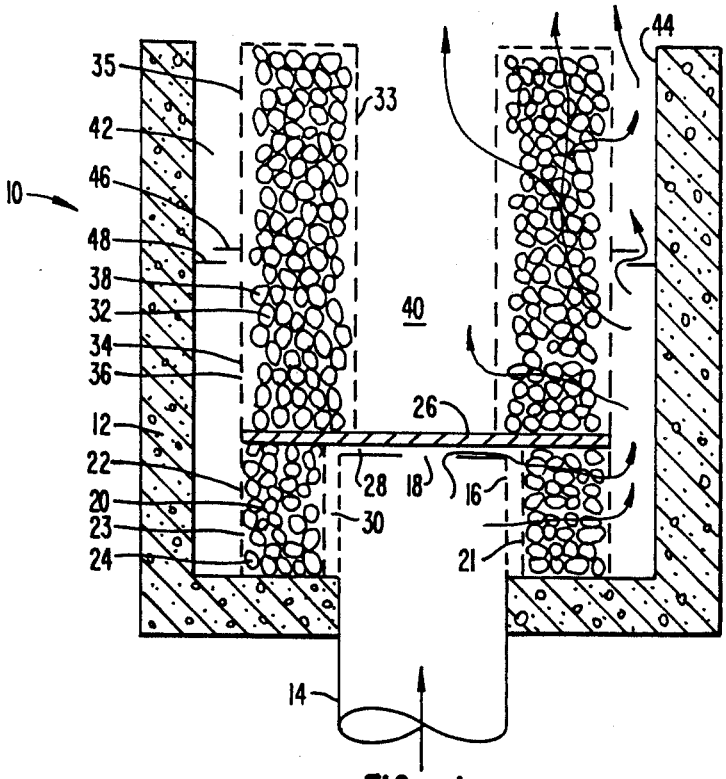
FIG. 1 shows a sectional schematic view of the preferred embodiment of this invention.
Figure 2:
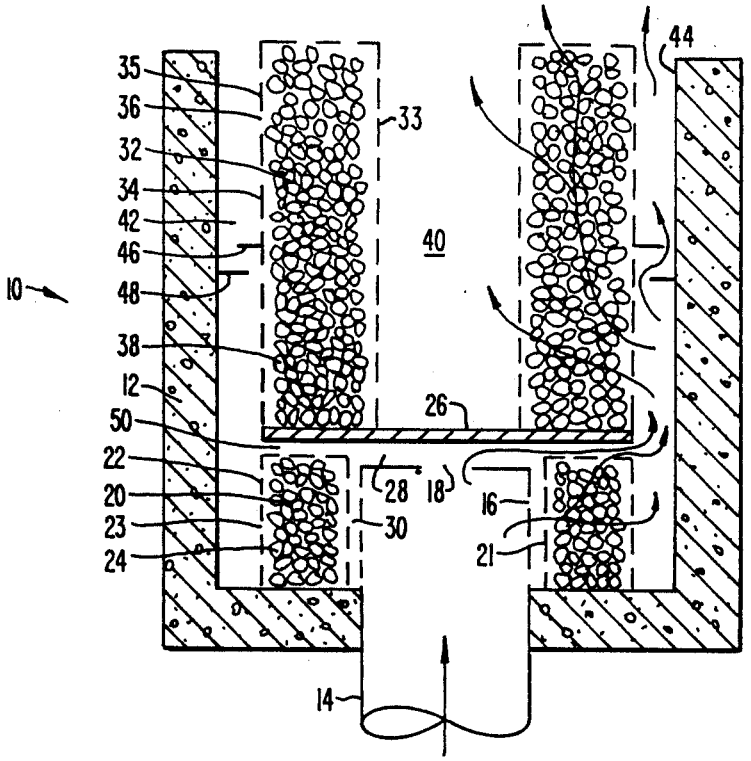
FIG. 2 shows a sectional schematic view of the embodiment of FIG. 1 under a high fluid flow condition.

The muffler according to the preferred embodiment of this invention is shown in FIGS. 1 and 2. The exterior housing 12 is open-ended and preferably has a substantially circular cross-section, although any other cross-sectional shape (such as rectangular) would also be acceptable. Instead of being open-ended, housing 12 may have a partially closed end with an exit port for emitting the fluid flowing through the device.

Housing 12 is preferably constructed in one piece of steel plate which is about ¼ inch thick and has an internal diameter of about three feet and a height of about eight feet. A muffler of these dimensions reduces noise from a stream of geothermal steam of 100,000 pounds per hour at a pressure of 200 psig by about 50 decibels. The dimensions of housing 12 will vary, of course, depending upon the pressure-volume parameters of the vented fluid. As an alternative to steel plate, housing 12 may be formed from reinforced concrete. Housing 12 may also be made in more than one piece and may be formed from masonry, wood, earth (as in a berm or pit), or any other suitable material.

The high pressure fluid is admitted into the muffler via inlet pipe 14. Pipe 14 may be attached to housing 12 by conventional means such as bolted flanges (not shown). Pipe 14 has one or more openings 16 sized to permit a satisfactory flow rate. In the preferred embodiment, pipe 14 is formed from steel and the openings 16 are one half inch in diameter. Pipe 14 has an opening 18 at its top end.

Surrounding a portion of inlet pipe 14 is a lower fill pack 20. In the preferred embodiment, lower fill pack 20 is a wire mesh cage 22 containing particles 24 of solid rock, porous rock, steel, cast iron, slag or the like. The configuration of these particles 24 is substantially spherical or irregular, but not flat. The particles define interstitial spaces between them through which the incoming fluid may flow to resist the flow, dissipate the speed, and attenuate the sound, of the flowing fluid. The size of the particles may range from about ⅛ inch to 18 inch average diameters. For the sake of clarity, FIGS. 1 and 2 show a space between the particles and the cage walls. Actually, however, particles 24 lie against the walls of cage 22.

Cage 22 has perforations 23 formed therein for allowing the passage of fluid through the fill pack. The cross-section of fill pack 20 may be rectangular, circular, or any other shape suitable for conforming to the shape of housing 12.

As shown in FIG. 1, a plate 26 is disposed above lower fill pack 20 and is at least partially exposed to the flowing fluid, either upstream of fill pack 20 or downstream of fill pack 20. Plate 26 may be made from steel, concrete, or any other suitable material. Plate 26 and inlet pipe 14 bound a space 28 or cavity, and inlet pipe 14 and the inner surface 21 of fill pack 20 bound another space or cavity 30. One of the purposes of plate 26 is to direct fluid radially or sideways out of fill pack 20 into void 42 as discussed below. Another purpose of plate 26 is to accommodate an increase in the pressure of the flowing fluid as is also discussed below.

Disposed above plate 26 is an upper fill pack 32. As with the lower fill pack 20, fill pack 32 is preferably formed from a wire mesh cage 34 having perforations 36 formed therein. Fill pack 32 is filled with particles 38 which are the same as the particles 24 in fill pack 20. Particles 38 define interstitial spaces through which fluid may flow to resist the flow, dissipate the speed, and attenuate the sound, of the flowing fluid. For the sake of clarity, FIGS. 1 and 2 show a space between the particles and the cage walls. Actually, however, particles 38 lie against the walls of cage 34.

The inner surface 33 of fill pack 32 surrounds a void 40. Void 40 is in fluid communication with fill pack 32 via perforations 36. Another void 42 lies between the inner wall 44 of housing 12 and fill packs 20 and 32. Void 42 communicates lower fill pack 20 with upper fill pack 32 and communicates both fill packs with the open end of housing 12.

An obstruction 46 extends into void 42 from the outer surface of upper fill pack 32. A corresponding obstruction 48 extends into void 42 beneath obstruction 46 from surface 44 of housing 12. In the preferred embodiment, obstructions 46 and 48 are steel rings extending into void 42 from fill pack 32 and surface 44, respectively, and the distance between obstructions 46 and 48 is about 1 inch. The purpose of obstructions 46 and 48 is (1) to control the noise coming from void 42 and (2) to cause fill pack 32 to move upward to accommodate an increase in the pressure of the flowing fluid. While desirable, obstructions 46 and 48 are not necessary to the operation of the device.

In normal operation, pressurized fluid enters pipe 14 as shown by the arrow in FIG. 1. The fluid passes through openings 16 and opening 18 into spaces 30 and 28, respectively, and then flows into fill pack 20 through perforations 23. Plate 26 prevents the fluid from moving up directly into fill pack 32. The fluid therefore moves generally radially or sideways through the interstitial spaces around particles 24 and exits out into void 42. Fill pack 20 acts as a flow resistor; flow of the fluid through fill pack 20 dissipates the linear speed of the flowing fluid and attenuates the noise generally associated with high velocity flow of high pressure fluid.

After entering void 42, the flow splits. A portion of the fluid in void 42 flows between obstructions 46 and 48 and out of the open end of housing 12. Driven by the back pressure caused by obstructions 46 and 48 and the relatively low pressure in void 40, the other portion of the fluid passes through perforations 36 into fill pack 32 and through the interstitial spaces around particles 38. Like fill pack 20, fill pack 32 acts like a flow resistor; flow of the fluid through fill pack 32 dissipates the already-reduced linear speed of the flowing fluid and attenuates the noise of the fluid even more. Part of the fluid in fill pack 32 passes into void 40 before exiting housing 12, part of the fluid exits fill pack 32 at the top thereof without passing into void 40, and part of the fluid may pass back into void 42 before flowing through the open end of housing 2.

Figure 7:
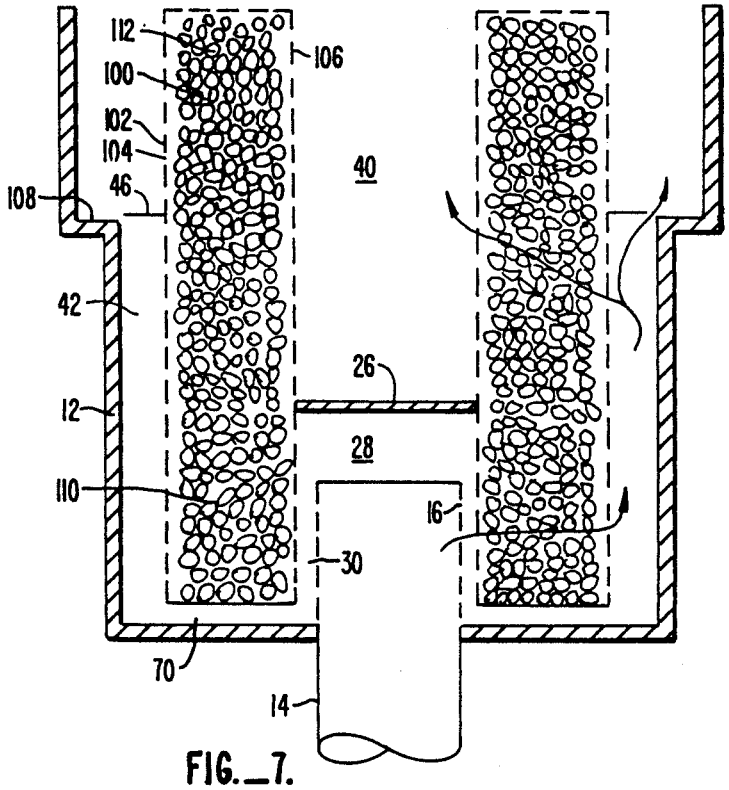
FIG. 7 shows another alternative embodiment of this invention.

It should be understood that plate 26 may have openings or perforations along the portion of plate 26 that jointly borders fill packs 20 and 32. The high flow resistance of fill pack 32 compared to the low flow resistance of void 42 ensures that substantially all of the fluid flowing into fill pack 20 will flow into void 42 before flowing into fill pack 32. In fact, the portion of plate 26 jointly bordering fill packs 20 and 32 may be eliminated altogether without substantially affecting the sound attenuating operation of the device. This feature is shown in FIG. 7.

FIG. 2 shows the operation of the preferred muffler embodiment during a higher than normal surge of pressurized fluid. Higher fluid pressure acting against plate 26 and obstruction 46 will raise plate 26 and fill pack 32 above their resting place on fill pack 20. This movement opens a flow path 50 above fill pack 20. This movement of fill pack 32 also increases the size of the space between obstructions 46 and 48, thereby permitting more fluid to flow through void 42 to the top of housing 12. One or more stops (not shown) may be provided, such as on surface 44 of housing 12 or across the top of housing 12 to limit the upward movement of fill pack 32.

The dimensions of the upper and lower fill packs may be changed to alter the operational parameters of the muffler. For example, making lower fill pack 20 smaller than upper fill pack 32 makes the fluid flow linear velocity through fill pack 20 greater than the flow velocity through fill pack 32. This disparity in flow rates means that lower fill pack 20 will achieve a greater overall noise reduction than fill pack 32. Also, the slower flow velocity through fill pack 32 will generate less flow noise than will the flow through the lower fill pack 20. Preferably, the fluid flow rate through lower fill pack 20 is between one and twenty times greater than the linear flow rate through upper fill pack 32. In addition, the size, placement and spacing of obstructions 46 and 48 affects the proportion of fluid which will flow through fill pack 32 and the proportion of fluid which will flow directly through void 42 to the top of housing 12.

Cages 22 and 34 and particles 24 and 38 of fill packs 20 and 32, respectively, may be replaced with one or more layers of perforated or slotted metal, grills, screen, or grates. The perforations define spaces into which the incoming fluid may flow. This alternative embodiment will likely be more rugged than the cage and particle embodiment although perhaps less effective in reducing undesirable sound.

Figure 3:
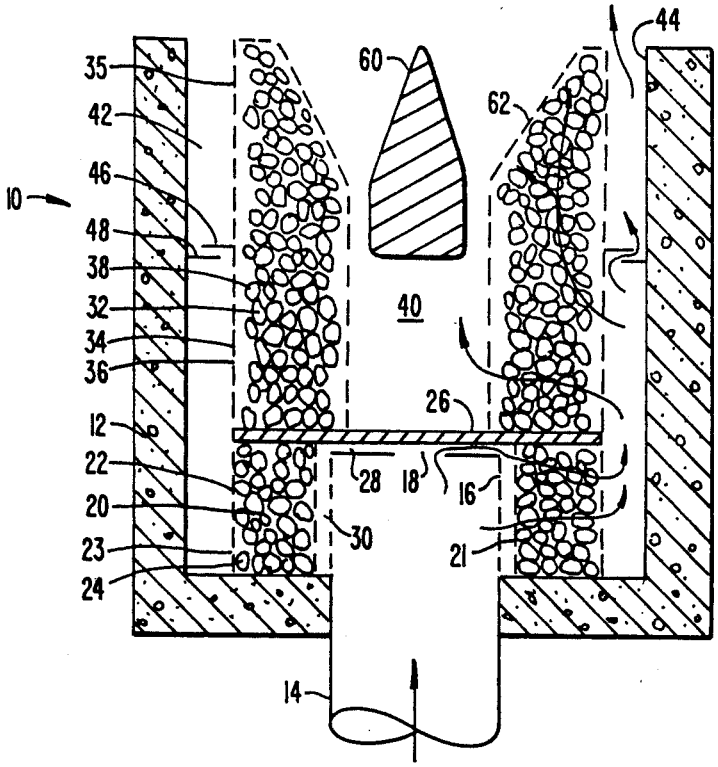
FIG. 3 shows an alternative embodiment of this invention.

FIG. 3 shows an alternative embodiment of this invention. A plug 60 is placed in central void volume 40. Plug 60 helps block sound from void 40 as it directs flow through void 40 and, possibly, redirects some flow into void 42. Plug 60 may be solid, hollow, or made of a sound absorptive material.

FIG. 3 also shows a tapered portion 62 formed in upper fill pack 32. The tapered portion helps diffuse the fluid flow through void 40, thereby decreasing the outlet velocity and decreasing the sound level of the muffler. This feature may be used with the plug 60 or independently of the plug. While FIG. 3 shows the taper 62 on only one side, both sides of fill pack 32 may be tapered to achieve the fluid diffusing effect.

An alternative or additional means of decreasing outlet velocity would be to widen the open end of housing 12, either by gradually increasing the diameter of the housing or by providing a sudden step increase in the housing diameter near the open end. An example of this step feature is shown as element 108 in FIG. 7. In addition to decreasing the exit velocity of the fluid, the step in housing 12 could replace obstruction 48 if obstruction 46 is disposed properly adjacent the step.

Figure 4:
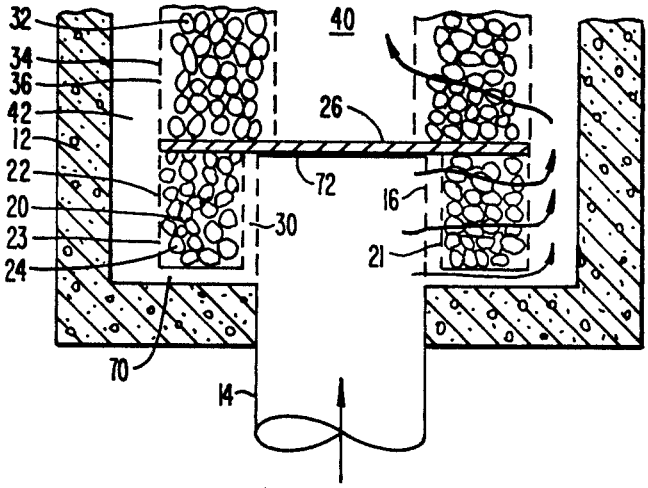
FIG. 4 shows another alternative embodiment of this invention.

FIG. 4 shows an alternative embodiment in which a space or bypass passage 70 is provided beneath fill pack 20. The passage width is preferably 15% of the distance between plate 26 and the bottom of housing 12, but could be up to 60 or 70% of this distance. The purpose of passage 70 is to permit a portion of the incoming fluid to bypass fill pack 20, which increases the muffler's capacity. Fill pack 20 may be intermittently supported above the floor of housing 12 by blocks (not shown) or by any other suitable means. In addition, the embodiment of FIG. 4 eliminates opening 18 in pipe 14 and space 28 or cavity above pipe 14.

Figure 5:
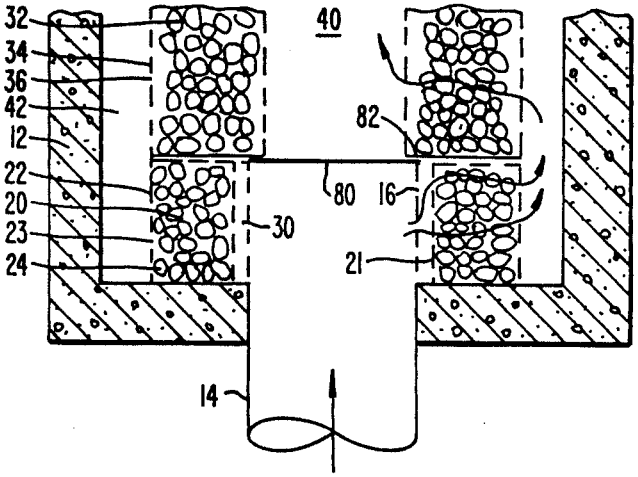
FIG. 5 shows yet another alternative embodiment of this invention.

FIG. 5 shows yet another embodiment of this invention. This embodiment eliminates plate 26. Pipe 14 has a closed end 80. In addition, cage 34 of fill pack 32 has a solid bottom 82 which rests on top of fill pack 20 and closed end 80 of pipe 14.

Figure 6:
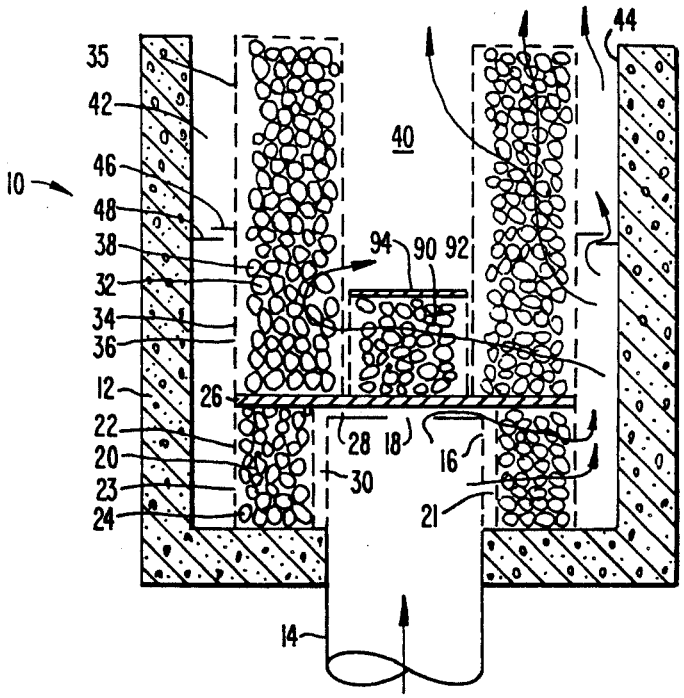
FIG. 6 shows still another alternative embodiment of this invention.

FIG. 6 shows an embodiment in which the upper fill pack 32 has an additional particle-filled section 90. Section 90 rests on plate 26 and is separated from the rest of fill pack 32 by a cage 92. Section 90 has a solid or perforated cover 94 on its upper surface. Optionally, section 90 may be made a portion of fill pack 32 by eliminating the portions of the cages between them.

FIG. 7 shows an alternative embodiment in which the upper and lower fill packs are replaced by a single fill pack 100. Fill pack 100 is formed from a cage 102 having perforations 104 formed therein. In this embodiment, plate 26 extends across the inner surface 106 of fill pack 100 and separates space 28 from void 40. Fill pack 100 rests on supports (not shown), and the bottom of fill pack 100 and the inside surface of housing 12 define a space 70 below fill pack 100.

FIG. 7 also shows an alternative embodiment for housing 12. Housing 12 is provided with a step 108 disposed just below obstruction 46.

In normal operation, fluid flows from inlet pipe 14 through spaces 28 and 30 into a lower section 110 of fill pack 100, defined generally as the portion below plate 26. Fluid may also flow around lower section 110 through space 70. The relatively low pressure in void 42 draws substantially all of the fluid radially or sideways from lower section 110 and into void 42. Only a small portion of the fluid entering lower section 110 flows upward into the upper section 112 of fill pack 100.

The fluid flowing in void 42 splits, a portion of the fluid going into upper section 112, and a portion of the fluid passing between step 108 and obstruction 46 and out of the open end of housing 12. If the incoming fluid pressure increases beyond the normal operating range, the entire fill pack 100 will rise up, thereby increasing the size of the flow path between step 108 and obstruction 46.

Figure 8:
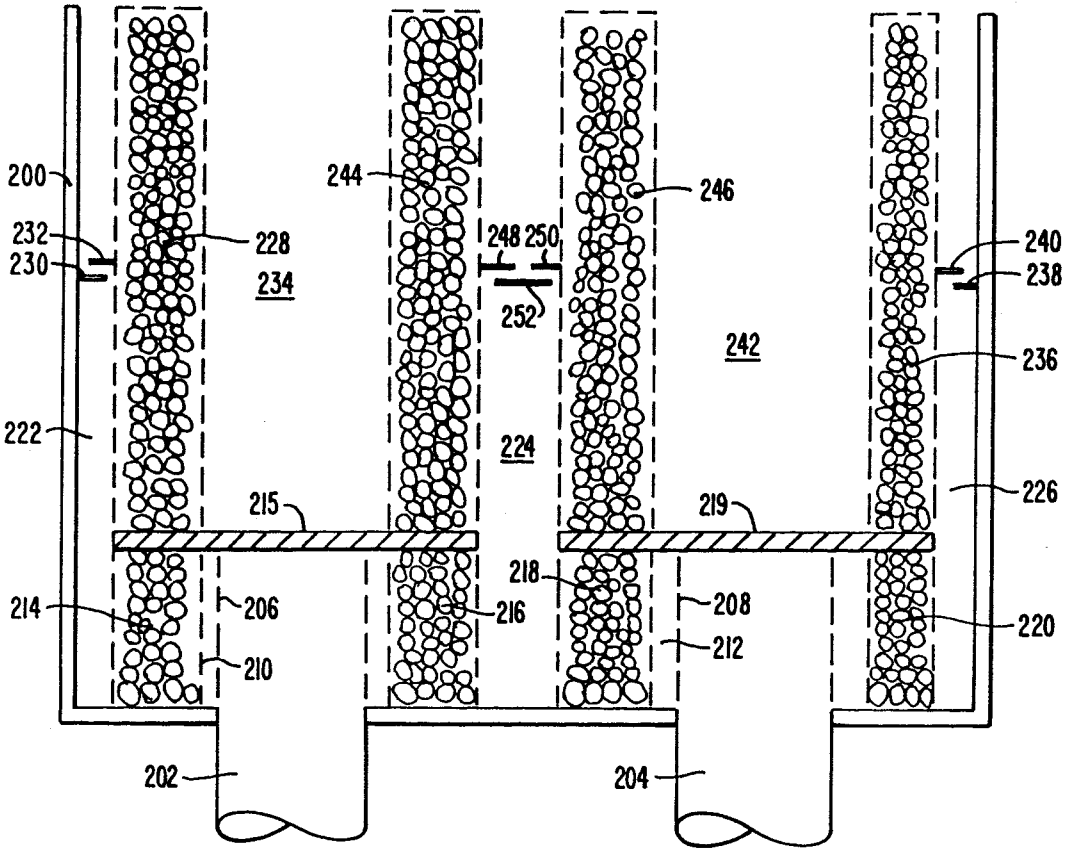
FIG. 8 shows yet another alternative embodiment of this invention.

FIG. 8 shows yet another embodiment of this invention. This embodiment has a housing 200 with a rectangular cross-section. High pressure fluid is introduced into housing 200 by inlet pipes 202 and 204. Inlet pipes 202 and 204 may be connected by a common manifold (not shown) upstream of housing 200. The fluid passes from inlet pipes 202 and 204 through openings 206 and 208, respectively, into spaces 210 and 212. Fluid in space 210 flow through parallel lower fill packs 214 and 216, and fluid in space 212 flows through parallel fill packs 218 and 220.

The fluid in fill pack 214 flows substantially sideways into void 222, the fluid in fill packs 216 and 218 flows substantially sideways into void 224, and the fluid in fill pack 220 flows substantially sideways into void 226. The fluid in void 222 then splits, with one subflow passing into upper fill pack 228 and a second subflow passing through obstructions 230 and 232 and out through the housing outlet at the top of the housing. Once in fill pack 228, the flow may split again, with a portion of the flow going into void 234 and then out of the housing, a portion flowing out of the housing through the top of fill pack 228, and a portion flowing back into void 222 and then out of the housing. The same process takes place in void 226.

With respect to the fluid in void 224, a first subflow passes into upper fill pack 244, a second subflow passes into parallel upper fill pack 246, and a third subflow passes around obstructions 248, 250 and 252 and out of the housing outlet. Obstruction 252 is supported in void 224 below obstructions 248 and 250 by any means.

In the case of a sudden rise in incoming fluid pressure in inlet 202, plate 215 and upper fill packs 228 and 244 move upward as a unit, thereby opening passages beneath the upper fill packs, between obstructions 230 and 232, and between obstructions 248 and 252. Likewise, if the fluid pressure in inlet 204 increases, plate 219 and upper fill packs 236 and 246 move upward as a unit, thereby opening passages beneath the upper fill packs, between obstructions 250 and 252 and between obstructions 238 and 240.

While the preferred embodiments show the use of a specific number of fill packs in the housing, any number of fill packs arranged serially or in parallel may be used, each giving all or a portion of the fluid flowing therethrough a substantially sideways velocity component into an adjoining void. The serial arrangement provides more noise reduction while the parallel arrangement increases flow capacity. The design of this invention is thus adaptable to many different applications.

Other modifications may be made without departing from the scope of the invention.

What is claimed is:

1. A method for muffling sound of flowing fluid comprising the steps of:

introducing a pressurized fluid into a first flow resisting means disposed within a housing having fluid inlet and outlet means;

passing substantially all of the fluid from the first flow resisting means into a first void disposed within the housing;

splitting the flow in the first void into first and second subflows;

passing the first subflow from the first void into a second flow resisting means disposed within the housing;

passing the first subflow out of the housing; and passing the second subflow from the first void out of the housing without passing into the second flow resisting means.

2. The method of claim 1 wherein all of the fluid passes from the first flow resisting means into the first void.

3. A method of claim 1 wherein the fluid moves substantially radially outward when passing from the first flow-resisting means into the first void.

4. The method of claim 1 wherein the first subflow moves substantially radially inward from the first void to the second flow resisting means.

5. The method of claim 1 wherein a portion of the first subflow passes into a second void formed within the second flow resisting means before passing out of the housing.

6. The method of claim 5 further comprising the step of passing the first subflow around a plug disposed in the second void before passing the first subflow out of the housing.

7. The method of claim 1 wherein a portion of the first subflow passes from the second flow resisting means back into the first void before passing out of the housing.

8. The method of claim 1 wherein the second subflow passes through a space disposed between two obstructions before passing out of the housing.

9. The method of claim 8 wherein one of the obstructions is attached to the housing.

10. The method of claim 8 wherein one of the obstructions is attached to the second flow resisting means.

11. The method of claim 8 further comprising the step of increasing the size of the space in response to an increase in the pressure of the flowing fluid.

12. The method of claim 1 further comprising the step of passing the fluid through interstitial spaces formed in the first flow resisting means.

13. The method of claim 1 further comprising the step of passing the second subflow through interstitial spaces formed in the second flow resisting means.

14. The method of claim 1 further comprising the step of dividing the flow into a plurality of subflows before introducing the flow into the first flow resisting means.

15. A device for muffling the sound of flowing fluid, the fluid having a pressure and the device having fluid resistance characteristics, comprising:

a housing;

a fluid inlet disposed in the housing;

a fluid outlet disposed in the housing;

a first void disposed in the housing, the void being in fluid communication with the fluid outlet of the housing;

first means for attenuating the sound of flowing fluid, the first means being disposed in the housing, the first means having an inlet and an outlet, the first attenuating means inlet being in fluid communication with the fluid inlet of the housing, the first attenuating means outlet being in fluid communication with the first void;

second means for attenuating the sound of flowing fluid, the second means being disposed in the housing, the second means having an inlet and an outlet, the second attenuating means inlet being in fluid communication with the first void, the second attenuating means outlet being in fluid communication with the fluid outlet of the housing; and means for splitting the fluid flowing in the first void into first and second and separate subflows, the first void communicating the first subflow with the first attenuating means inlet and the second subflow with the fluid outlet of the housing.

16. The device of claim 15 wherein the means for splitting comprises an obstruction disposed in the first void.

17. The device of claim 16 further comprising third means for attenuating the sound of fluid, the third attenuating means being disposed downstream of the second void.

18. The device of claim 17 wherein the third attenuating means is an expansion of a cross-sectional flow area of the second void disposed substantially at the fluid outlet of the housing.

19. The device of claim 15 wherein the housing is a unitary structure formed from steel.

20. The device of claim 15 wherein the fluid inlet of the housing comprises an inlet pipe.

21. The device of claim 20 wherein the inlet pipe has openings for dividing the fluid flow into a plurality of fluid flows.

22. The device of claim 15 wherein the fluid outlet of the housing comprises an opening formed in the housing.

23. The device of claim 15 wherein the first void substantially surrounds the outlet of the first attenuating means and the inlet of the second attenuating means, the first void being disposed between the first and second attenuating means, thereby separating the first attenuating means outlet from the second attenuating means inlet.

24. The device of claim 15 further comprising a bypass passage arranged in parallel with the first means for attenuating, the bypass passage permitting a portion of the flow from the fluid inlet of the housing to bypass the first means for attenuating.

25. The device of claim 15 further comprising a second void in direct fluid communication with the second attenuating means outlet but not in direct fluid communication with the first means for attenuating.

26. The device of claim 25 wherein the second void is in direct fluid communication with the fluid outlet of the housing.

27. The device of claim 25 further comprising a plug disposed in the second void.

28. The device of claim 15 wherein the means for splitting further comprises means for accommodating a change in the pressure of the flowing fluid by changing the fluid resistance characteristics of the device.

29. The device of claim 28 wherein the means for accommodating comprises means for moving the second means for attenuating within a range of movement.

30. The device of claim 29 wherein the means for moving comprises a plate attached to the second means for attenuating, a portion of the plate being exposed to the flowing fluid.

31. The device of claim 29 wherein the means for moving comprises an obstruction attached to the second means for attenuating, the obstruction being exposed to the flowing fluid in the first void.

32. The device of claim 31 wherein the means for moving further comprises a second obstruction attached to the housing, the second obstruction being disposed adjacent the first obstruction.

33. The device of claim 29 further comprising means for limiting the range of movement of the second means for attenuating.

34. The device of claim 15 wherein the first means for attenuating comprises a plurality of particles disposed in a container, the particles defining interstitial spaces between them.

35. The device of claim 34 wherein the second means for attenuating comprises a plurality of particles disposed in a container in fluid communication with the first means for attenuating, the particles defining interstitial spaces between them.

36. The device of claim 15 wherein the first means for attenuating comprises a plurality of layers of perforated metal, the perforations defining interstitial spaces through which fluid may flow.

37. The device of claim 15 further comprising third means for attenuating the sound of fluid, the third attenuating means being disposed downstream of the first void.

38. The device of claim 37 wherein the third attenuating means is an expansion of the cross-sectional flow area of the first void disposed substantially at the fluid outlet of the housing.

39. A device for muffling the sound of flowing fluid comprising:

a housing;

a fluid inlet disposed in the housing;

a fluid outlet disposed in the housing;

a first void disposed in the housing, the void being in fluid communication with the fluid outlet of the housing;

first means for attenuating the sound of flowing fluid, the first means being disposed in the housing, the first means having an inlet and an outlet, the first attenuating means inlet being in fluid communication with the fluid inlet of the housing, the first attenuating means outlet being in fluid communication with the first void, the first void surrounding the outlet of the first attenuating means;

second means for attenuating the sound of flowing fluid, the second means being disposed in the housing, the second means having an inlet and an outlet, the second attenuating means inlet being in fluid communication with the first void, the second attenuating means outlet being in fluid communication with the fluid outlet of the housing, the first void being disposed between the first and second attenuating means, thereby separating the first attenuating means outlet from the second attenuating means inlet, the first void surrounding the inlet of the second attenuating means;

a second void in direct fluid communication with the outlet of the second attenuating means and with the fluid outlet of the housing but not in direct fluid communication with the first attenuating means; and means for splitting the fluid flowing in the first void into first and second separate subflows, the first void communicating the first subflow with the first attenuating means inlet and the second subflow with the fluid outlet of the housing.

40. The device of claim 39 wherein the second attenuating means lies substantially between the first and second voids within the housing.

* * * * *